US006955313B2

(12) United States Patent
Paolini

(10) Patent No.: US 6,955,313 B2
(45) Date of Patent: Oct. 18, 2005

(54) HAMMER MILLS

(76) Inventor: Antonio Palmiro Paolini, Via Pio XI, 22, Salerno (IT), IT-84125

( * ) Notice: Subject to any disclaimer, the term of this patent is extended or adjusted under 35 U.S.C. 154(b) by 179 days.

(21) Appl. No.: 10/380,871

(22) PCT Filed: Sep. 11, 2001

(86) PCT No.: PCT/IT01/00470

§ 371 (c)(1),
(2), (4) Date: Mar. 13, 2003

(87) PCT Pub. No.: WO02/22269

PCT Pub. Date: Mar. 21, 2002

(65) Prior Publication Data

US 2004/0035966 A1 Feb. 26, 2004

(30) Foreign Application Priority Data

Sep. 14, 2000 (IT) ..... NA2000A0063

(51) Int. Cl.[7] ..... B02C 13/06

(52) U.S. Cl. ..... 241/189.2; 241/154; 241/186.2; 241/186.4

(58) Field of Search ..... 241/154, 186.2, 241/186.4, 189.2

(56) References Cited

U.S. PATENT DOCUMENTS 2,148,022 A * 2/1939 Haaland ..... 241/101.6
2,505,674 A * 4/1950 Knight ..... 241/37.5
3,637,145 A * 1/1972 Williams ..... 241/189.2
4,166,583 A * 9/1979 Ruckstuhl ..... 241/73
5,402,948 A * 4/1995 Kaczmarek ..... 241/73
5,505,390 A * 4/1996 Rodgers ..... 241/48

* cited by examiner

*Primary Examiner*—Derris H. Banks
*Assistant Examiner*—Jason Y. Pahng
(74) *Attorney, Agent, or Firm*—Mark D. Wieczorek, Esq.

(57) ABSTRACT

The present invention concerns improvements in hammer mills, secondary and tertiary, reversing and not, that allow to resolve problems tied to the shattering of the inert hammers. Through the use of a special device circular of rotation, endowed with blades of interception in equal number to that of the hammers that launches the inert material against the front of the hammers, obtaining the shattering totally to impact, in place of the traditional shattering for crushing between hammers and armours. The surprising resulted obtained include an increase of production from about double to about triple, with an almost complete absence of recycle portions; good polyhedric nature and granulometry, with a drop of about 70% of dust in the obtained product; reduction of usury in the hammers and armour; possibility to produce thin sands, with non attainable speed with traditional mills; an almost complete absence of dust freed during the operation with consequent elimination of environmental impact and guardianship of the health of the employees to jobs.

15 Claims, 5 Drawing Sheets

HAMMER MILLS

TECHNICAL FIELD

The present invention concerns improvements in the hammer mills, both secondary and tertiary, reversing and not reversing, for the making of inert materials.

BACKGROUND

Current hammer mills used in making inert materials have several problems: an elevated percentage of recycling with repercussions on productivity, a high percentage of dust in the obtained product, problems of environmental impact and guardianship of the health of the workers in the environments of the job due to the the enormous quantity of dust that is emitted by the mill, bad granulometry and polyhedric nature of the obtained product (including a scarce presence of thin parts with an excess of dust), and strong usury of the hammers and the armored walls.

A principal cause of ineffectiveness is the strong peripheral speed of the hammers necessary to break the inactive material, which does not allow an easy passage of the same material in front of the hammers.

In tertiary mills, to be able to arrive to treat chippings up to thirty millimeters in diameter, is may be necessary to arrive to a peripheral speed around 70 m/s, while in the secondary mills, with chippings of the order of a hundred millimeters at the most, it is necessary to reach almost 40 m/s. Such speeds are too high to allow the penetration of the inert material with those dimensions, in an extremely little time (around 3/100 of second for the tertiary mill and around double for the secondary mill), on the front of the hammer.

The physical phenomenon that may be verified is clearly seen if a simulation of the operation of a mill is performed, for example of a tertiary mill, to two hammers for the production of sand, with a personal computer. As soon as chippings are introduced in the mill it is noticed that the hammer, already from the first impact, and having once taken a certain quantity of inert materials, interferes with chipping particles. It is created, that is, an interference phenomenon between the superior particles not intercepted, whose entity is strongly tied, over that to the aforesaid peripheral speed of rotation (above all), also to the thickness of heading of the hammer and the thickness of the chippings flow of feeding that arrives from the height in free fall. These particles of chippings, do not regularize because of the high frequency of beat of the hammer in time (about thirty times a second for the tertiary mills to two hammers). And then, above all when the edge of the hammer begins to become round for the usury, the chippings, practically do not arrive anymore to be intercepted by the front of the hammer, as they float around the perimetric circumference of the rotor and the wall armored of the mill, through a space that becomes more and more tightened, thin to be forced to the crushing in a point that depends on the dimensions of the same chippings.

From here the necessity to endow the traditional mill of a special register of approach of the armored wall, in comparison to the perimetric circumference of the hammer (to establish the maximum sizing of the inert material from obtaining to crushing and to compensate the usury of the superior part of the hammer).

The results of this traditional system to crushing are, inevitably, negative.

SUMMARY OF THE INVENTION

The present invention is an improvement in hammer mills, both secondary and tertiary, reversing and not reversing, for the making of inert materials. One embodiment uses a special rotating device that intercepts the flow of feeding of the inert materials, and is endowed with tapered blades with a minor peripheral speed rotary and a small thickness to a free extremity, and is able to launch the inert materials in a discontinuous mode, violently against the front of the hammers and which may be only in the moment in which pass the hammers.

The present invention allow a system of making which totally impacts the front of the hammer, instead of the traditional crushing.

Keeping in mind the aforesaid problems that determine the phenomenon of interference and, therefore, the making to crushing(strong peripheral speed of rotation and thickness of heading of the hammer, as well as the width of the flow of fed material), the current system uses a special rotating device of interception of the inert material, analogous to that of the traditional mill, but which has parts that intercept (blades), characterized by a minor peripheral speed rotary and from a minor thickness of heading; all fed by a more narrow flow of feeding. Once intercepted the inert material can be launched violently against the front of the hammer. The launch happens in a discontinuous way, only in the moment in which the hammer, for which the heading of the same is not struck by the inactive material passes and, therefore, interference is not had among the varied particles of inert material. It is in this way, resolving the problem of the interference with the adoption of an effective device of interception of the inert material, that the impact is assured on the front of the hammer.

The reaching of the impact on the front of the hammer may resolve various of the above mentioned problems in the traditional system of making. Results have been seen in computer simulations and also from tests effected on a prototype of a hammer mill.

In some embodiments, the following has been seen:

- increase of production from about the double, in comparison to the traditional mills with new hammers, to about the triple, in comparison to the traditional mills with consumed hammers;
- nearly nonexistent recycle;
- energy's electric reduction employee to around the half, to parity of production;
- reduction of about 70% of dust in the final product;
- nearly an absence of dust freed by the mill toward the external environment (strong reduction of environmental impact, with guardianship of the health of the workers in the environments of job);
- good polyhedric product obtained;
- good granulometry of the inert material, with sands that have elevated percentages of thin parts; a different granulometry can be gotten in operation of the speed of impact (is enough change the pulley of the motor);
- reduction of usury of the hammers and armored walls; to specify that such usury, contrarily to how much it happens in the traditional system, it doesn't provoke any inconvenience, relatively to the constancy in fact of production, electric energy, dust, polyhedric nature, granulometry, etc.

Besides the classical rotor with the hammers, such innovative mills as per embodiments of the invention introduce, superiorly, to only some centimeter of distance, a second rotor (rotating device of interception) whose diameter is, in operation, of the dimensions of the inert material to treat (a little smaller for the secondary mill and much more for the tertiary mill), and which is endowed with lo special blades in an equal number to that of the hammers, and which is set in phase (same number of turns in a unit of time) with the principal rotor through special organ of toothed transmission. The principal characteristic of such second rotor is that to receive the inert material from a high point, to invite it according to a circular trajectory and to launch it against the front of the hammers of the mill, in an almost perpendicular direction to the front of the hammer. For example, referring to FIG. 1, the vector component second the direction of the speed of the hammer, is slightly less (5–7%) in comparison to the same vector of the speed of throwing. This means that the speed of throwing is gone to almost entirely add, in intensity, to the peripheral speed of the hammer that strikes the inert material. Considering that already the first impact of the shattering of the material reaches about 70%, the principle result of this above-mentioned characteristic may be that:

keeping in mind the contribution of the speed of throwing, the peripheral speed of rotation of the mill can be enormously decreased, above all for the secondary (it can almost be halved), also preserving the necessary speed of impact to break the inactive material, with the principal advantage of an easier and controlled penetration of the same inactive material toward the front of the hammer (we have seen how are to dissuade strong peripheral speeds of rotation towards the phenomenon of interference). In more, in the tertiary mill, this system allows, operating with chippings of small dimension (around 10 mm), to arrive, without decreasing peripheral speed of rotation of the mill (it is not necessary, because the penetration in the rotating device of interception is very easy when the inactive material is small) but making use of the aforesaid additional speed of throwing, to speeds ever reached till now (over 90 m/s); the result being thin sands, not obtainable with current mills;

due to the throwing of the material almost perpendicular to the front of the hammer, can be reduced, in the phase of impact, the tangential tensions, with consequent better polyhedric nature of the inactive material broken and reduction of dust;

due to the most approach of the two aforesaid rotors (only some centimeter) is guaranteed with the maximum precision of the reaching of the objective (impact point), with a consequent improvement of the uncontrollable effects in the phase of throwing and impact.

BRIEF DESCRIPTION OF THE DRAWINGS

These and other characteristics, as well as advantages, will be evident from the following description and from the enclosed drawings, furnished only for indicative purposes and not to be limitative, in which.

DESCRIPTION

Figure 1:
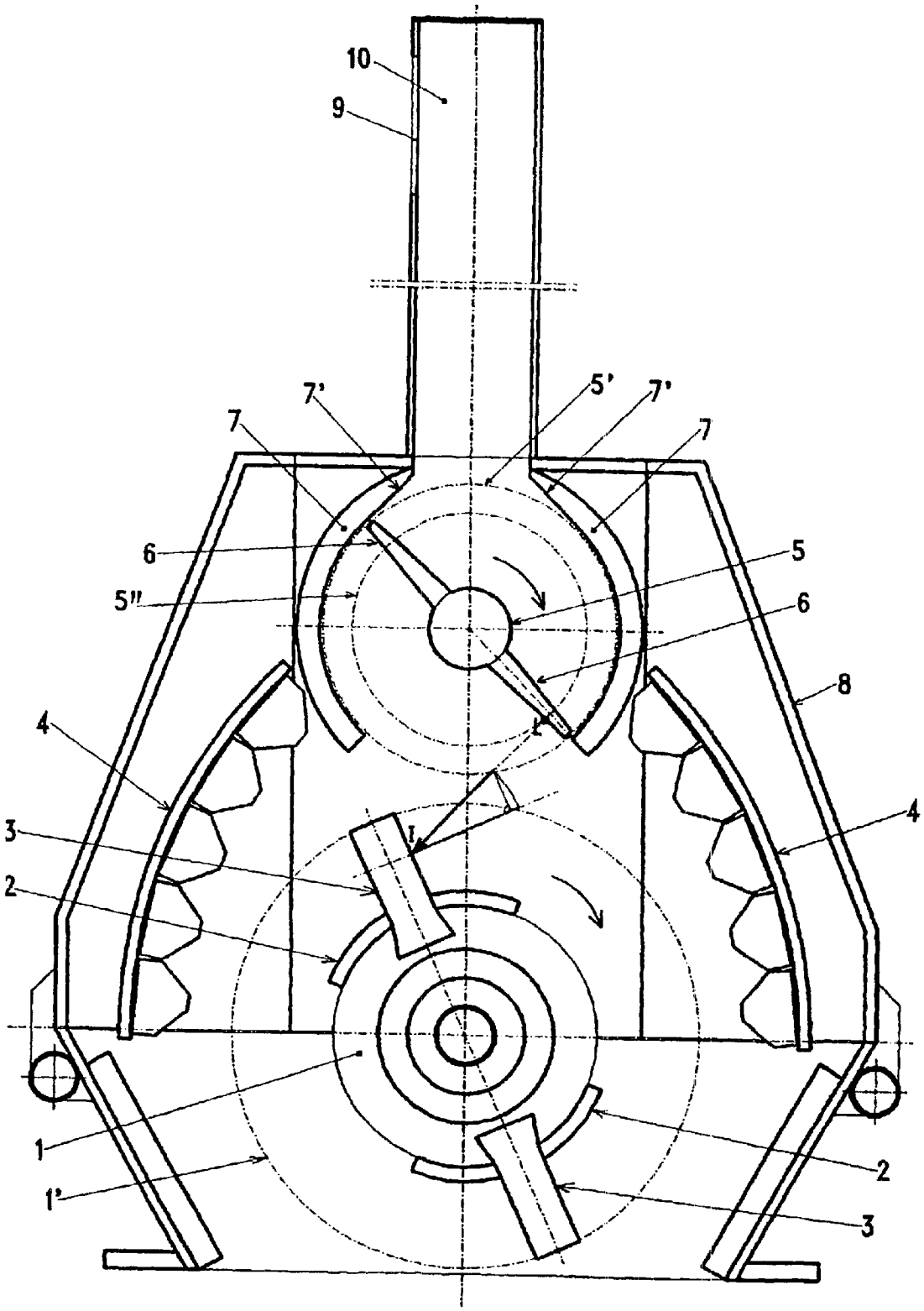
FIG. 1 shows a transversal section of a hammer mill, secondary, reversing, totally to impact.
Figure 2:
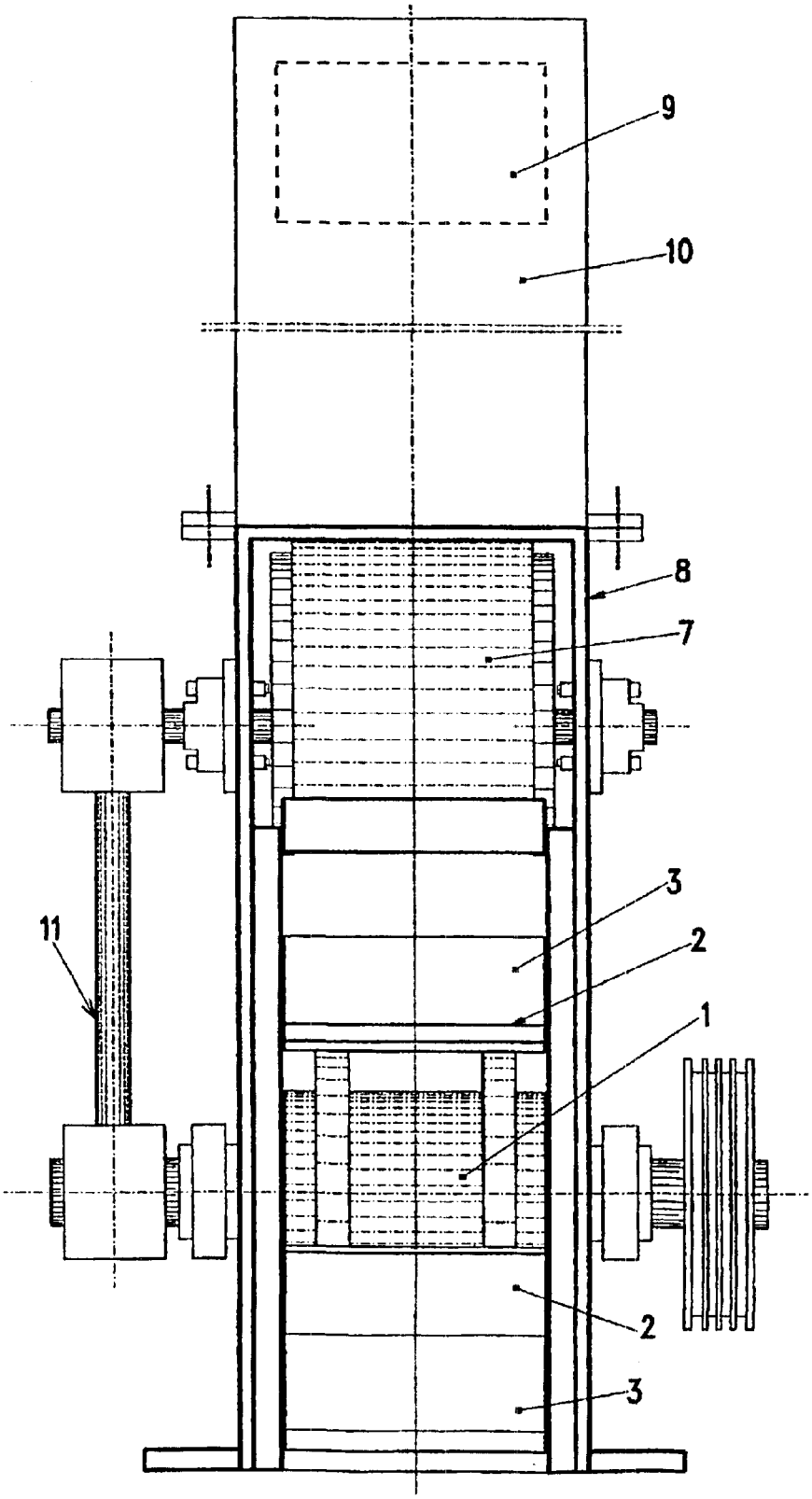
FIG. 2 shows the longitudinal section of the mill of FIG. 1.
Figure 3:
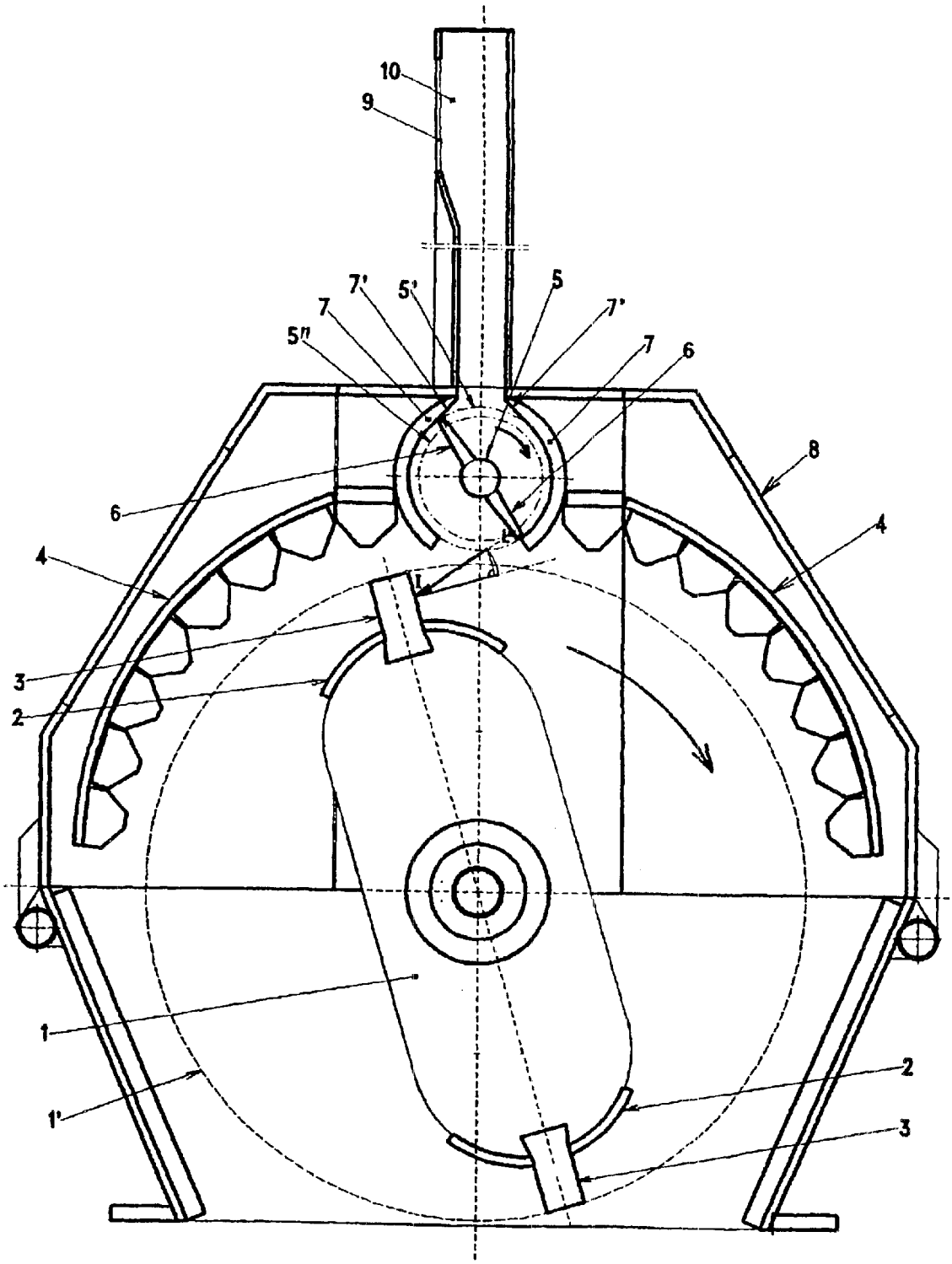
FIG. 3 shows a transversal section of a hammer mills, tertiary, reversing, totally to impact.
Figure 4:
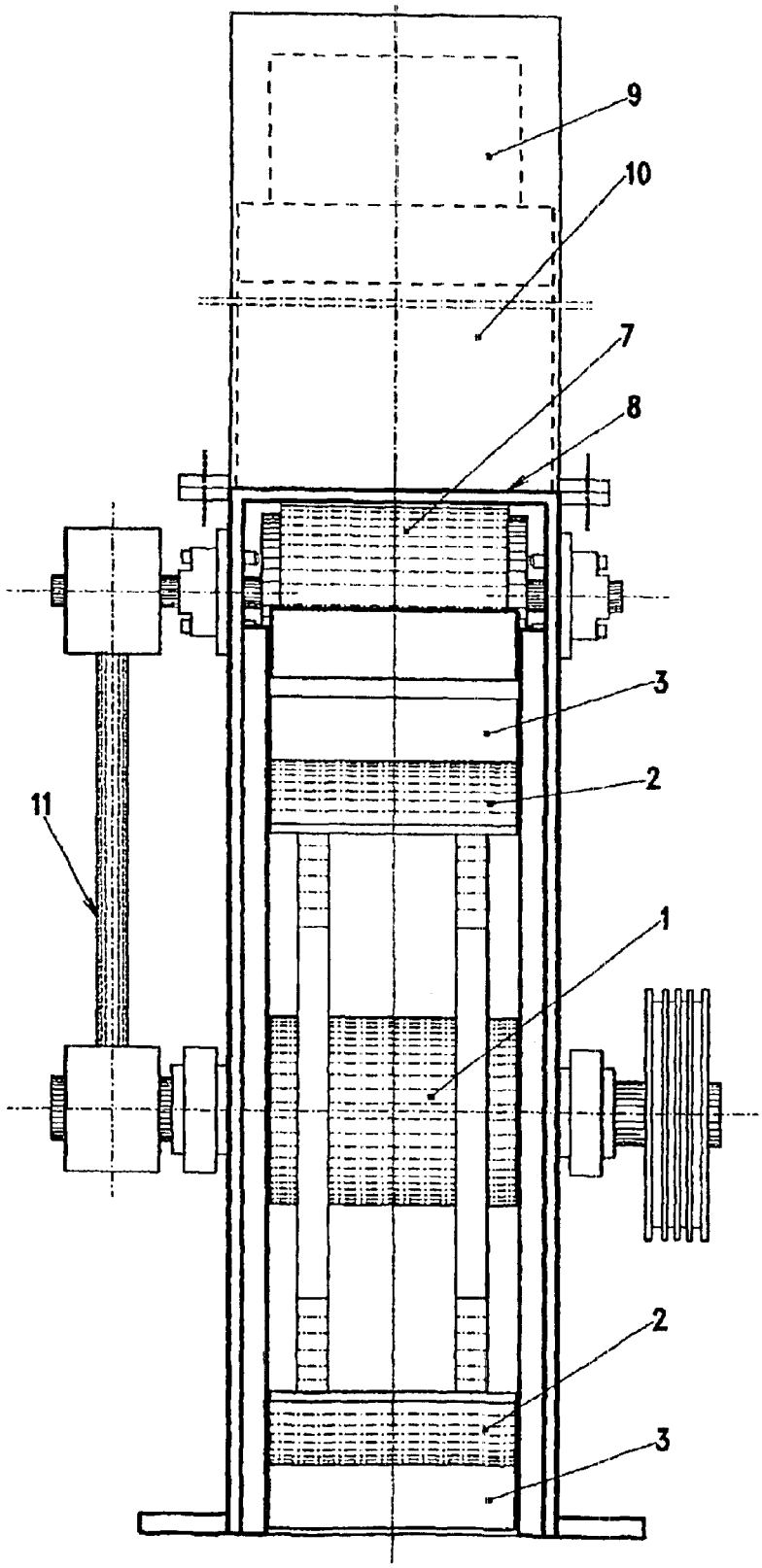
FIG. 4 shows the longitudinal section of the mill of FIG. 1.

In the description that follows we refer for simplicity to the secondary mill of FIG. 1 and FIG. 2 and note that a similar description applies for the tertiary mill of FIG. 3 and FIG. 4, having appended to these sets of figures the same representative numerals of the varied parts of the machine.

And then, with reference to the secondary mill of FIG. 1 and FIG. 2, the principal rotor is pointed out (1) and relative orbit perimetrale (1'), the protections (cover flywheels) anti usury (2), two (preferablly, but they can be also greater than two) hammers (3), the armored walls (4) and all those other parts mechanics presents currently in every mill, that here are not recalled. To keep in mind that, not having crushing, the registers of approach of the armored walls, fundamental for the traditional mills, lack reason to exist anymore; such walls will be fixed and the most distant possible from the hammers (it is sufficient about fifty millimeters both in the secondary mill and in the tertiary mill). Superiorly, the nearest possible, to some centimeter of distance from the rotor (1), there is another of it (rotating device of interception), smaller, that is termed secondary rotor (5), with relative orbit perimetric (5'), endowed with special taper blades (6) (the taper facilitates the entry of the material) in equal number to that of the hammers, as well as of two (can be also unique) lateral circular invitations (7) with the edges superior internal beveled (7') and joined (to facilitate the entry of the inert material) tangentially to the peripheral (5'). The carcass (8) of the mill contains everything how much aforesaid. The two rotors are connected and compelled to perform the same number of turns in the unit of time (put in phase), through a special organ of toothed transmission (11); such organ is endowed with device of interruption (joint) of the transmission that automatically begins working, in case of block of the due secondary rotor, for example, to some greater stone, or to an iron piece, that would be possible to occasionally fit. The organ of transmission can be also represented by a simple toothed belt that connects the two axes of rotation endowed with equal pulleys; in such case the belt must be adequately proportioned, so that, following an irregular block of the secondary rotor, can easily be broken, to be replaced.

It completes the machine to include a a hopper load (10), that will be narrow, and compatible with the inactive material to be treated (about a hundred millimeters for the tertiary mill and about double that for the secondary mill). The hopper is endowed with a window (9) for the insertion of the feeder of load.

The sizing of a mill, above all as ratio between the diameter of the greater inferior principal rotor and the secondary superior (rotating device of interception) smaller, depends in the first place on the dimensions of the inactive material to treat; such relationship is varying around from 1.5 to 2 for the secondary mills (transformers of crushed stones in chippings) and from around 4 to 7 for the tertiary mills (manufacturing of sand, departing from the chippings).

We now pass to the description of the operation of the mill.

The inactive material (crushed stones) from the window (9) of the hopper of load (10), arrives on the blades of interception (6) of the secondary rotor (rotating device of interception). The height of fall and, therefore, of the hopper, is calculated keeping in mind that, in the existing time between a beat and the other of interception of the blades (around 6/100 of second for the secondary mill and around half that for the tertiary mill), the inactive material, in gravitational free fall, has to cover a run equal to the length of the blades in the radial direction; this to allow the total filling of the blades themselves. In the case that some piece of crushed stones, for uncontrollable circumstances, desultorily does not succeed in entering the invitations, (7), the blades (6), adequately proportionated as mass, will provide also to the breakup of the same piece. In contrary case it will automatically begin working the device of interruption (joint) of the organ of transmission.

Once intercepted by the blades the inert material is compelled to cover a barycentric trajectory circular (5") and on account of the centrifugal strength it is positioned in the most external zone, for then to be launched in a tangential direction, toward the front of the hammer.

As it regards the mass in phase between the two rotors, it is proceeded as follows.

Once established opportunely the point of impact I, the necessary fraction of time is calculated for covering the run of the inert material, from the point of throwing L to that of impact I. In base to this time, common also to the principal rotor, the position of the hammer (3) is calculated during the throwing. At this stage will be affixed some notches of reference, so that the mass in phase can be restored in every moment, particularly in case of automatic driving of the device of interruption (joint) of the organ of toothed transmission (11), in case of irregular block of the secondary rotor (5). Obviously, others will serve similar notches of reference to keep track of the reversibility of rotation of the machine in the case that the mill is realized reversing.

A last consideration is made on the particular form assumed by the rotating device of interception of the inert material in the case in which the mill is not realized reversing. This is represented in the constructive detail of FIG. 5 that refers to a rotating device of interception of a tertiary mill, but which may also apply for a secondary mill.

Figure 5:
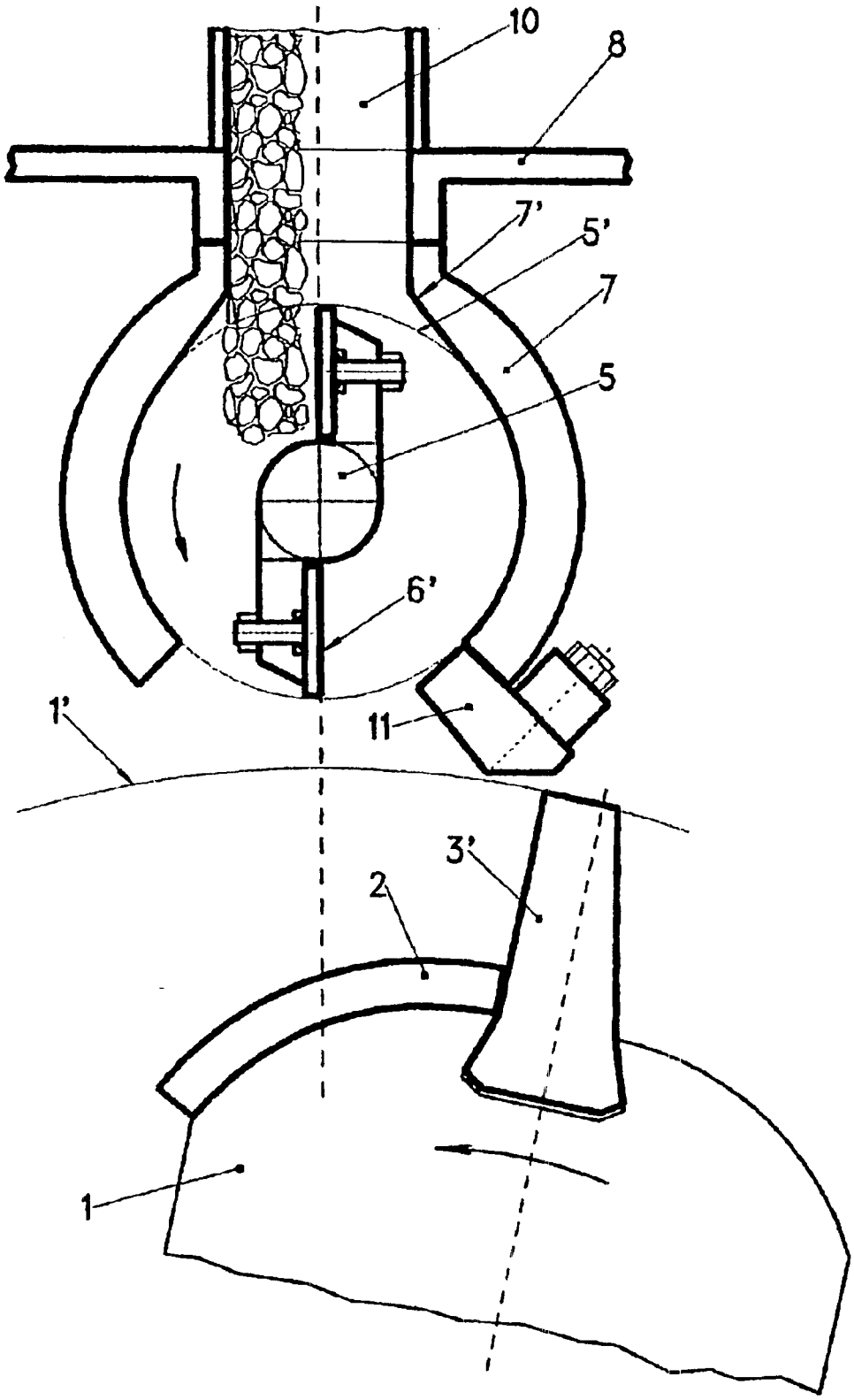
FIG. 5 shows the constructive detail of a hammer mills, tertiary, not reversing, totally to impact.

Referring to FIG. 5, if the rotation happens only in a sense, it is possible to foresee the blades of interception (6') that can be dismantled, through the adoption of a blade holder fixed to the axle of rotation; in such way it is easier and economic, especially in the zones with material that is very abrasive, the replacement of the blades, once they wear out. Also, in this case, the reduced thickness of the free extremity of the blades is guaranteed, having the adroitness to realize a suitable inclination (is more than sufficient at 50%) to the free extremity of the blade holder; such inclination is proportional to the speed of rotation of the blades and the speed of gravitational free fall of the inert material. To hold it also foresees the predisposition of the flow of inert material that goes down in a gravitational way to have a thickness that is more reduced; the inert material, slightly beating on a front of the hopper of load, is disposed according to a band that is narrow. Given the non-reversibility of the machine, it is clear that would be enough for only one invitation (7), but the necessity of have an internal form with a perfectly constant bending, makes it preferable to opt for a better solution of two invitations, easily realizable in the foundry, in a only circular piece with a superior admission port for the material entrance and an inferior port for the exit; in this way, the advantage of the reversibility of the invitations will also be had (all it takes is horizontally rotating by 180°), to exploit especially in those zones with inert materials a lot of abrasives. Always in the case in which the mill is realized as not reversing, it is possible to apply a special corrector of throwing (11) to the inferior extremity of the invitation, to avoid that some grain of inert material escapes to the impact through the superior part of the hammer.

Other advantages offered by certain embodiments of the non reversing mill is the fact that the hammers, not working on both the front, can be realized to be tapered (preferred form also structurally), with consequent economic advantage that derives of it.

What is claimed is:

1. A mill of two or more hammers for the making of inert material, comprising:

a hopper for a load with a window, a housing coupled to the hopper so as to receive material from the hopper, the housing containing:

a principal rotor having a relative peripheral orbit, a protection for anti usury coupled to said principal rotor;

at least one hammer coupled to said principal rotor, a set of armored walls substantially surrounding said principal rotor, a secondary rotor having a relative peripheral orbit, such that the diameter of the relative principal peripheral orbit is greater than that of the secondary rotor, and further such that the ratio between the diameters of the principal and the secondary peripheral orbits is variable; according to the dimensions of the inert material to be treated; and wherein a peripheral circumferences of each of the two rotors is placed, one in comparison to the other, substantially near each other, and wherein the secondary rotor has a number of blades in an equal number to that of the hammers of the principal rotor; and wherein said secondary rotor is surrounded by at least one lateral curvilinear invitations having superior edges inside beveled and tangentially joined to the relative peripheral orbit; and wherein the hammers are set to a distance by the armored walls and the same have substantially no registers of approach; and wherein the protections for anti usury have a width substantially equal to the inside width of the mill.

2. The mill of claim 1, wherein for the an apposition of opportune notches of reference, for the restoration in every moment of the mass in phase of the two rotors, the reversibility of rotation of the machine can be obtained.

3. The mill of claim 1, wherein the blades of the secondary rotor have a linear taper along their longitudinal direction, with a reduced dimension of heading, such that the same does not interfere with a flow of material that comes from the hopper.

4. The mill of claim 1, wherein the blades can be dismantled and can be applied to a blade holder substantially on the axle of rotation; the blade holder having a beveled heading, with about a 50% inclination.

5. The mill of claim 1, wherein to an extremity of one of the two invitations a device is applied to address the inert materials on the front of the hammers.

6. The mill of claim 1, wherein the hammers are tapered.

7. The mill of claim 1, wherein the housing is structure and configured such that material from the hopper is intercepted by the blades of one of the rotors and is accelerated to a speed on a circular trajectory and launched from a barycentric point L, in a tangential direction, against the hammer, such that a component of a speed of throwing is added to the peripheral speed of the hammer, increasing a speed of impact.

8. The mill of claim 7, wherein the speed of throwing component of the speed of impact allows a reduction in the peripheral speeds of the principal rotor and of the secondary rotor, or of the number of turns of the rotors themselves whereby an easier interception of the inert material from the blades is achieved.

9. The mill of claim 1, wherein the flow of feeding of the material in the hopper is maintained substantially adherent to an opposite wall to that in which the window is present and further wherein if the flow of inert material goes down adherent to the left wall of the hopper, the sense of rotation of the blades is counterclockwise; and if the flow of inert material goes down adherent to the right wall of the hopper, the sense of rotation of the blades is clockwise such as to improve the interception of the inert material with the blades.

10. The mill of claim 1, wherein the armored walls are separated from the hammers to avoid the breakup of the inert material by crushing, such that the milling of the materials happens substantially solely by impact.

11. The mill of claim 7, wherein in part due to the throwing of the material against the hammers and due to a short distance between the two peripheral orbits, the phase of throwing and impact is optimized.

12. The mill of claim 1, wherein the mill is a secondary mill, and wherein the ratio between the diameters of the principal and the secondary peripheral orbits_is about 1.5 to 2.

13. The mill of claim 1, wherein the mill is a tertiary mill, and wherein the ratio between the diameters of the principal and the secondary peripheral orbits_is about 4 to 7.

14. The mill of claim 1, wherein the mill is a reversible mill.

15. The mill of claim 1, wherein the mill is a non-reversible mill.

* * * * *

UNITED STATES PATENT AND TRADEMARK OFFICE

CERTIFICATE OF CORRECTION

PATENT NO. : 6,955,313 B2
APPLICATION NO. : 10/380871
DATED : October 18, 2005
INVENTOR(S) : Antonio Palmiro Paolini It is certified that error appears in the above-identified patent and that said Letters Patent is hereby corrected as shown below:

On the title page item (57), Abstract, line 6, change “launches”, to - - launch - -.

On the title page item (57), Abstract, line 9, change last word “resulted” to - - results - -.

Col. 1, line 24, before “may”, change “is” to - - it - -.

Col. 2, line 38, after “about” delete - - the - -.

Col. 2, line 40, after “about” delete - - the - -.

Col. 2, line 43, after “around” delete - - the - -.

Col. 4, line 7, after “two”, change “preferablly” to - - preferably - -.

Col. 4, line 9, after “mechanics”, change “presents” to - - present - -.

Claim 1, Col. 6, line 22, after “peripheral”, change “circumferences” to

- - circumference - -.

Claim 1, Col. 6, line 29, after “curvilinear”, change “invitations” to - - invitation - -.

Claim 7, Col. 6, line 54, change last word “structure” to - - structured - -.

Claim 12, Col. 8, line 6, after “orbits” delete - - _ - -.

Claim 13, Col. 8, line 10, after “orbits” delete - - _ - -.

Col. 3, line 1, after “with” delete - - to - -.

UNITED STATES PATENT AND TRADEMARK OFFICE

CERTIFICATE OF CORRECTION

PATENT NO. : 6,955,313 B2
APPLICATION NO. : 10/380871
DATED : October 18, 2005
INVENTOR(S) : Antonio Palmiro Paolini It is certified that error appears in the above-identified patent and that said Letters Patent is hereby corrected as shown below:

Claim 1, Col. 6, lines 19-20, change “vari-able;” to - - vari-able - -.

Claim 2, Col. 6, line 37, after “for” delete - - the - -.

Signed and Sealed this

Fifteenth Day of August, 2006

JON W. DUDAS
*Director of the United States Patent and Trademark Office*